United States Patent [19]

Scheffers

[11] Patent Number: 4,517,788

[45] Date of Patent: May 21, 1985

[54] MECHANISM FOR FILLING BAGS OF DIFFERENT SIZES

[75] Inventor: Richard W. Scheffers, Mount Prospect, Ill.

[73] Assignee: Signode Corporation, Glenview, Ill.

[21] Appl. No.: 429,507

[22] Filed: Sep. 30, 1982

[51] Int. Cl.[3] ..... B65B 41/18; B65B 57/02; B65B 43/26

[52] U.S. Cl. ..... 53/459; 53/468; 53/481; 53/51; 53/570; 53/371; 226/32; 226/143

[58] Field of Search ..... 53/51, 384, 385, 386, 53/459, 468, 469, 473, 480, 492, 550, 553, 562, 567, 568, 570, 481, 371; 141/10, 114 X, 165, 166 X, 313, 314, 315, 316, 317; 226/27, 32, 33, 115, 143

[56] References Cited

U.S. PATENT DOCUMENTS

| | | | |
|---|---|---|---|
| 3,021,988 | 2/1962 | Focht | 226/143 X |
| 3,198,228 | 8/1965 | Naito . | |
| 3,291,177 | 12/1966 | Naito . | |
| 3,338,284 | 8/1967 | Ausnit . | |
| 3,340,116 | 10/1967 | Naito . | |
| 3,359,703 | 12/1967 | Quaadgras | 53/567 X |
| 3,477,196 | 11/1969 | Lerner . | |
| 3,553,934 | 1/1971 | Johnson et al. . | |
| 3,597,895 | 8/1971 | Jensen . | |
| 3,618,286 | 11/1971 | Membrino | 53/459 |
| 3,744,211 | 7/1973 | Titchenal et al. . | |
| 3,952,480 | 4/1976 | Nordstrom . | |
| 3,977,586 | 8/1976 | Hertrich | 226/143 X |
| 4,260,116 | 4/1981 | Collin . | |

*Primary Examiner*—Horace M. Culver

*Attorney, Agent, or Firm*—Hill, Van Santen, Steadman & Simpson

[57] ABSTRACT

An automated bag filling machine particularly adapted to handle reclosable fastener strip profile-type plastic bags fed into the machine in a bag chain employs stations for opening, filling, reclosing, and separating filled and closed bags from the remainder of the chain. The drive means for conveying the chain through the filling mechanism include stroke control devices which enable the operation of the machine to be changed over for handling bags of different width sizes. Means are also provided for automatically preventing the bags in the chain from excessively over traveling their proper registration points with the various work stations.

13 Claims, 17 Drawing Figures

V
M
B
20
21
31
36
40
41
42
43
44
45
46
47
48
49
50
51
52
53
54
55

FIG. 15
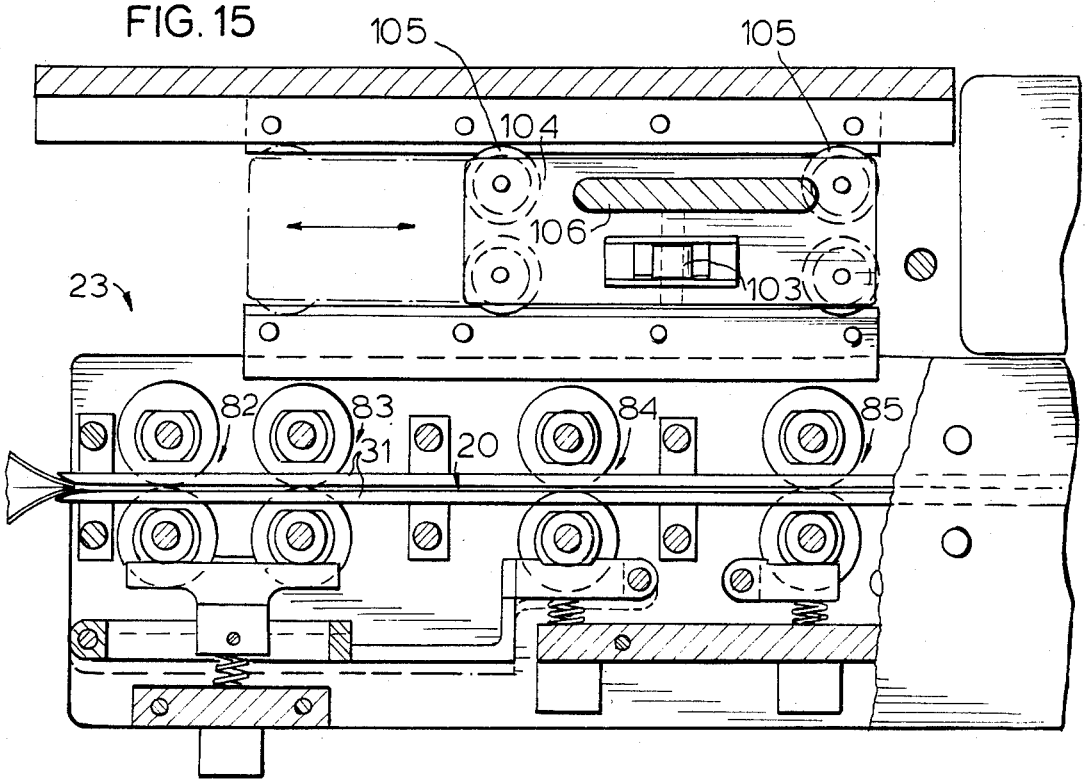
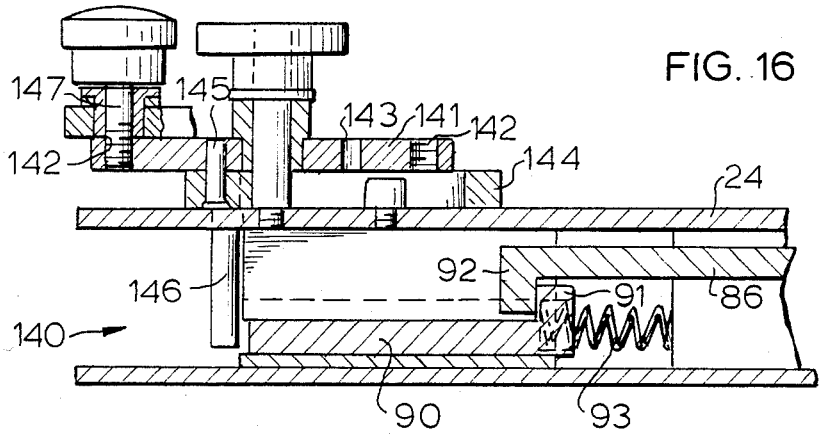
FIG. 16

MECHANISM FOR FILLING BAGS OF DIFFERENT SIZES

CROSS-REFERENCE TO RELATED APPLICATIONS

The instant application relates to subject matter disclosed in the following commonly assigned U.S. patent applications, all filed Sept. 30, 1982, concurrently with this application:

(1) Ser. No. 429,506 entitled "Registration Of Bags In A Filling Machine", by Richard W. Scheffers, (2) Ser. No. 429,508 entitled "Plastic Bag Chain", by Peter Lems, and (3) Ser. No. 429,617 entitled "Method And Mechanism For Filling Bags", by Peter Lems.

BACKGROUND OF THE INVENTION

The invention relates to an automated bag filling machine and method of operation therefore in which a chain of interconnected reclosable plastic bags are individually opened, filled, closed, and separated from the chain for packaging and, more particularly, to improvements in such a machine and method whereby changeover from an operation of filling bags of one size to a operation of filling bags of a different size is possible in a quick and simplified manner.

Prior to the instant invention, mechanisms for automatically feeding, loading, and sealing plastic bags have been devised. Prior art arrangements of this type are shown, for example, in U.S. Pat. No. 3,477,196 and U.S. Pat. No. 3,952,480. Both of these patents relate to mechanisms for conducting in seriatim a series of plastic bags, originally opened at one mouth end and connected together in a bag chain, to a loading station where the bags are individually loaded with material deposited through their open mouth ends and then to a closing station where the mouth ends of the bags are individually closed by heat sealing means.

No automatic bag loading mechanism has heretofore been commercialized to handle reclosable lock plastic bags of the type disclosed, for example, in U.S. Pat. No. 3,198,228 and presently manufactured by Minigrip, Inc., of Orangeburg, N.Y. This form of bag has closed bottom end and side edges and a reclosable upper end mouth having interlocking fastener strip rib and groove profiles running across inner facing surfaces of the mouth. The nature of manufacture and operation of the reclosable plastic bags present all together different handling problems than those presented by bags arranged for heat seal closing. For instance, reclosable fastener plastic bags are typically closed at their mouth ends during the manufacture process in order to allow proper interfitting of the rib and groove members and exit the manufacturing site in that closed condition. The bag mouths must be opened at a loading site to permit filling and then closed again for packaging.

Heretofore known automatic bag loading devices, such as disclosed in U.S. Pat. No. 3,477,196 and U.S. Pat. No. 3,952,480, are not capable of feeding, filling, and sealing reclosable fastener strip plastic bags, since the bag handling mechanisms of these devices are not conducive or adaptable to the unique characteristics of the reclosable bags.

It has been necessary to provide manual loading of reclosable lock bags, making such a loading operation very expensive in terms of labor costs and requiring much time since the loader must first manually open the initially closed bag, deposit fill material into the bag, manually interlock the bag near mouth fastener strip profiles, and finally transfer the loaded bag to a packaging station. U.S. Pat. No. 3,744,211 discloses an automatic bag filling apparatus for handling reclosable fastener strip profile bags connected together in a chain; however, this mechanism is not known to be commercialized and calls for the use of a one-step spring force to pull apart the interlocked fasteners of an empty bag in order to permit filling. Due to the rather delicate nature of plastic bags, this one-step opening action would probably often lead to undesirable tearing of the bag material so as to not be all together commercially practical.

The corresponding co-pending application Ser. No. 429,617 concerns a method and apparatus for feeding, opening, loading, and reclosing fastener strip profile plastic bags in an automated fashion, such that the filling operation can be accomplished quickly, inexpensively, and reliably given the relatively delicate nature of plastic bags. The machine disclosed in that application, however, is set for handling bags of a predetermined, substantially common width size and does not enable the operator to readily change over operation to handle bags of a different size.

The present invention relates to an automated bag filling machine specifically adapted to handle a chain of bag elements of the reclosable fastener strip profile type, which can be readily adjusted to change over operation to handle bags of different sizes within a range of sizes and which permits quick, inexpensive, and reliable feeding, opening, loading, and reclosing of this type of plastic bag.

SUMMARY OF THE INVENTION

An automatic mechanism for transporting, opening, filling, closing, and separately discharging reclosable fastener strip profile plastic bags sequentially one at a time is arranged to handle the bags in a vertically draped orientation and laterally connected together with one another in a chain. The bags have reclosable upper mouth ends permitting access to the bag interiors formed with laterally interlocking fastener strip profiles. The chain is conducted along a lateral transport path through the mechanism supported by guide track means which receive relatively outwardly protruding surfaces of the fastener profiles.

Initially, the bags enter the mechanism with their mouth ends closed in the fashion they typically leave manufacture and are sequentially passed to a first work station for opening. There, each bag stops while a single gripper conducts one fastener profile further along the transport path relative to the other corresponding opposed profile so as to unlock a portion of the profile strip forming an initial loop opening in the bag mouth at a lead end thereof. A probe member descends into the loop opening and the bag is conducted into a second work station such that the remainder portion of the profiles become separated and the bag mouth is open. The probe is resiliently biased in a rearward direction, such that, when the bag fully enters the second work station, the tail end of the bag is held against a stop means preventing further backward movement of this end of the bag. At the second work station, a further probe is inserted into the open mouth end of the bag near the middle of the bag mouth.

A positive reverse drive action is performed on the downstream portion of the bag chain causing a slack build-up in the open bag contained in the second work station which transversely separates the opened bag fastener profiles to widen the bag mouth opening for filling. After this has been accomplished, fill material is deposited into the open bag at the second work station.

The chain is then indexed forward by positive drive means passing the filled bag profiles out of the second work station through a converging guide which joins the profiles back together in locked engagement. The filled and closed bag is then passed into a drive station area in which there is performed a reverse movement on the filled and closed bag to permit the subsequent bag in the chain to be opened and filled in the second work station.

The filled and closed bag is then further forward indexed in the drive station until the outwardly protruding portions of its fastener strip profiles are engaged between forward-only drive wheels, such that, when a subsequent backward indexing of the chain is accomplished, this filled and closed bag is separated from the chain at lateral connecting links. The now separated filled and closed bag is then driven forward out of the drive station for discharge from the filling machine, possibly proceeded by passage through a sealing station for sealing the top edges of the bag mouth to form a pilfer-proof lock.

The drive station and further probe mechanism are contained on a laterally movable carriage which is adjustable along the length of the machine for proper spacing with respect to the particular size or width of bag being filled. The extent of operation or strokes of the positive drive devices in the drive station are controllably adjustable so that the extent of stroke movement may be set by the operator for the particular bag size or width being filled. In order to assure proper registration of each bag of the chain in the work stations, a solenoid-operated automatic control is provided which cooperates with the chain drive means to take corrective action with respect to drive strokes should excessive over-travel develop in the chain as it passes into the second work station.

Operation of the automated bag filling machine is continuous and fully mechanical, without requiring pressurized shop air.

BRIEF DESCRIPTION OF THE DRAWINGS

FIG. 15 is a cross-sectional view taken along the lines XV—XV of FIG. 2.

FIG. 16 is a cross-sectional view taken along the lines XVI—XVI of FIG. 14.

DESCRIPTION OF THE PREFERRED EMBODIMENTS

The present invention is directed to a packaging apparatus and method particularly adapted for automatically loading reclosable fastener strip profile-type plastic bags. These bags are formed of flexible thin plastic film and have c osed bottom and side edges and a reclosable upper end mouth. Running fully along opposed inner facing surfaces of the mouth are a pair of cooperatively interlocking fastener strip profiles formed with respective engageable rib and groove elements. The specific nature of manufacture and handling of reclosable plastic bags is more fully disclosed, for example, in U.S. Pat. Nos. 3,198,228 and 3,291,177, 3,338,284, and 3,340,116. During the manufacture of reclosable plastic bags of this type, the releasable interlocking rib and groove elements of the individual bags are brought into relative registration so as to enable their engagement and then the bag sides are cut and heat sealed by a heated blade so as produce an individual rectangular shaped bag having a releasably closed mouth end. The bag mouth is typically opened by forcibly separating the corresponding opposed fastener strip profiles. A bag mouth is closed by the application of a pressing force which joins together the rib and groove elements. The fastener strips and bags are made of a conventional plastic material such as polyethylene.

Many of the features of this invention can be further appreciated by reference to the commonly assigned, co-pending application Ser. No. 429,617 referred to above.

Figure 1:
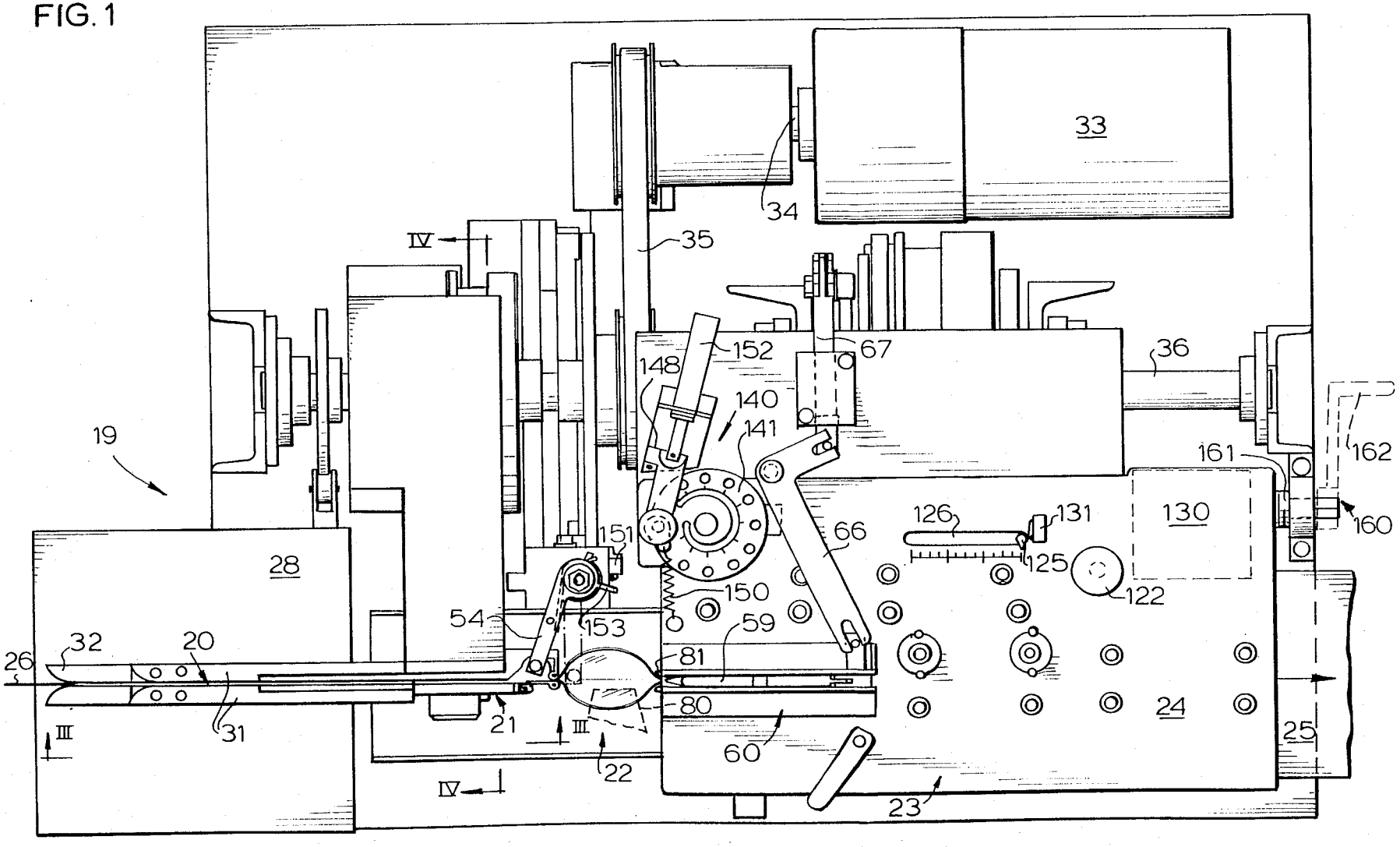
FIG. 1 is a plan elevational view of an automatic mechanism for loading reclosable fastener strip profile bags and permitting a changeover of operation to handle bags of different sizes constructed in accordance with the present invention.
Figure 2:
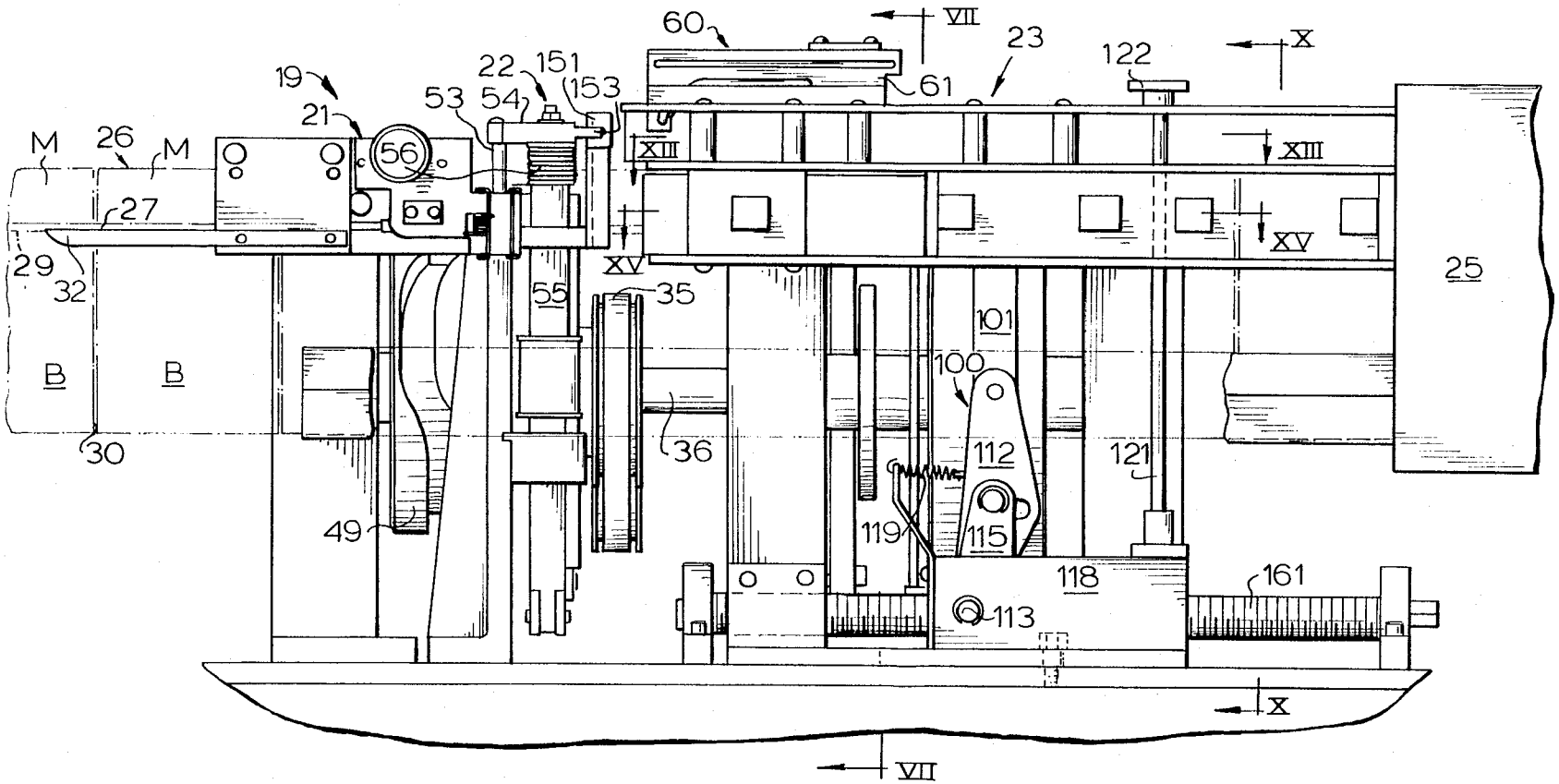
FIG. 2 is a side elevational view of the mechanism of FIG. 1.

FIGS. 1 and 2 serve to illustrate an overall packaging apparatus 19 for automatically loading reclosable fastener strip profile plastic bags one at a time. The apparatus 19 is composed of a series of work stations arranged along a lateral transport path 20 running through the apparatus between a trailing receiving end and a forwardmost discharge end. The apparatus contains, in sequence of operation on each bag, an initial loop bag opening station 21, a filling station 22 in which an open bag mouth is transversely widened to facilitate filling, and a drive station 23 disposed on a laterally adjustably movable carriage 24 in which each filled bag has its mouth profiles interengaged for closing and in which the filled and closed bag is separated by the rupture of tearable connecting links from the remainder of the chain. There may also be provided a suitable labeling or printing station 28 adjacent the initial loop bag opening station 21 for receiving the bags one at a time therethrough to perform suitable imprinting. There may also be provided downstream of the drive station 23 a suitable sealing mechanism 25, which may be attached to the drive station carriage 24, for sealing shut the free top edges of the bag mouths to form a pilfer-proof seal across the mouth ends of the filled and closed bags.

In order to permit automatic handling of the reclosable plastic bags, the bags B are serially arranged in a bag chain 26 to be passed in seriatim fashion along the transport path 20. The bags are vertically draped and interconnected with one another along adjacent side edges by means of a relatively weakened connecting link or thin plastic weld joint 27 which is positioned respectively adjacent the upper end mouth of the bag in line with the fastener strip profiles 29 on opposed sides of the bags. A vertically directed gap 30 is thus defined between each of the bags of the chain on each side of the connected link 27 between adjacent bags of the chain.

The bag chain 26 is conducted through the transport path 20 with the bag mouths M facing vertically upward. The bags in the chain may originally have their mouths M closed with the rib and groove profiles 29 fastened, or interlocked, in the typical production condition after manufacture. The transport path 20 is generally defined by a guide track means 31 having opposed facing parallel track surfaces defining a laterally extended flow space therebetween. Each of the track surfaces is formed with a recess respectively facing one another for receiving corresponding transversely protruding surfaces, here formed by the opposed profile elements of each bag's fastener strip 29. In this manner, each bag B of the chain is vertically supported on a recess ledge surface in the guide track 31 for movement there along. The guide track 31 has an entry portion 32 shown in FIGS. 1 and 2 for initially receiving the bags of the chain and conducting the bags through the apparatus 19.

The packaging mechanism 19 includes a continuous speed rotary drive motor 33 with a rotary output drive shaft 34 drivingly connected via suitable transmission elements, including a belt 35, to a laterally directed driven shaft 36. The shaft 36 extends substantially the lateral length of the mechanism 19 and provides a continuous rotary drive source for machine operation. Mechanical movements take place at each work station as a result of suitable drive take-offs from the shaft 36, such that the machine work stations operate continuously and simultaneously on the bags of the chain but sequentially on each bag of the chain.

The machine 19 serves to transport, open, fill, close, and separately discharge each bag of the chain 26 in the following manner. Each bag is laterally conveyed along the transport path 20 to the first work station 21, the details of which are shown in FIGS. 3–6. At this station, one fastener strip profile, such as the rib element, rests against a guide track surface portion while the corresponding opposed profile, such as the groove element, faces a rounded skid 41 formed at the lead end of an oscillating gripper 40. The gripper 40 is movable in a forward direction away from a stop pin 42 to engage against the facing of profile strip portion of the bag and slide the fastener element forwardly relative to the other fastener element, causing the fastener elements to separate and disengage such that an initial loop opening is formed at the lead end of the bag mouth.

The gripper 40 has a guide roller 43 extending beneath its lead skid surface end 41 and is pivotable about its center on a pivot rod 44 upstanding from a laterally pivotable cam follower link 45. The far end of the gripper 40 has a spring connection 46 such that the gripper 40 is resiliently biased in a clockwise direction about the pivot pin 44. Inward along the cam follower arm 45 is a journal 47 about which the arm 45 is laterally rotatable. The far end of the cam follower arm 45, opposed from the gripper mounted end, contains a downwardly extending cam follower roller 48 which is received in and follows the annular track surface of a rotary cam 49 keyed to the shaft 36.

Figures 3, 4, 5, 6:
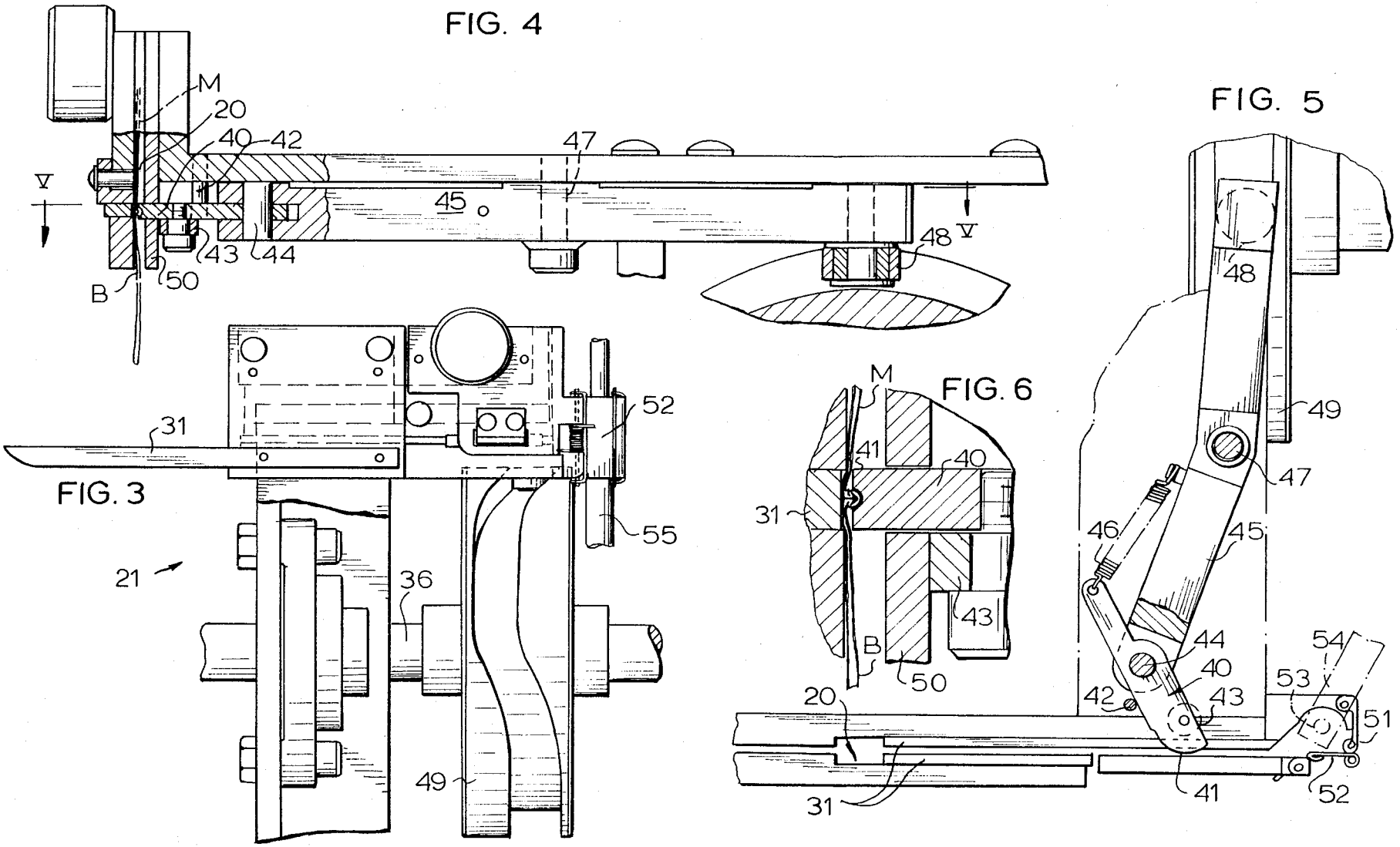
FIG. 3 is a cross-sectional view taken along the lines III—III of FIG. 1.
FIG. 4 is a cross-sectional view taken along the lines IV—IV of FIG. 1.
FIG. 5 is a cross-sectional view taken along the lines V—V of FIG. 4, illustrating the mechanism operating in an initial loop bag opening station for the mechanism of FIG. 1.
FIG. 6 is a fragmentary, cross-sectional view of the gripper mechanism employed in the initial loop bag opening station of FIG. 5.

During loop opening operation in the station 21, the track of the rotary cam 49 causes the cam roller end of the follower 45 to move rearward relative to the bag chain transport path 20, such that the gripper 40 passes forwardly along the transport path. As the gripper 40 moves away from the stop pin 42, its spring connection 46 biases the skid surface 41 outward against the facing fastener element profile of the bag to a point where the skid frictionally engages against the facing profile. The skid 41 is prevented from locking up against the bag by engagement of the roller 43 against a suitable disposed guide wall 50, as shown in FIG. 6. With the skid surface 41 of the gripper 40 so engaged against the facing fastener element, further forward movement of the gripper 40 causes slack build-up in the lead end of the bag mouth such that the lead end portions of the interlocked fastener strip profiles pop apart to form an initial loop opening. As shown in FIG. 5 this initial loop opening is formed immediately upstream of a pair of laterally swingable gates 51 and 52, between the nip of which passes the mouth end of the bag during forward movement into the next station 22. The gates 51 and 52 are prevented by suitable stop surfaces from moving further laterally backward from their positions shown in FIG. 5. These gates 51 and 52 are lightly biased toward their stop surfaces, so as to permit the mouth end of the bags passing from the station 21 to the station 22 to move freely in the forward direction.

Initially positioned directly over the loop opening formed at the lead end of the bag is a vertically reciprocable probe or finger member 53, shown in FIGS. 1–2 and 8–9. The probe 53 is supported at the end of a transversely directed support arm 54 which is pinned for relative lateral rotational movement at the upper end of a vertical bar 55. A suitable torsion spring 56 serves to connect the support arm 54 to the bar 55 in such a manner that the support arm is resiliently biased to swing the probe 53 in a laterally rearward direction. The lower end of the bar 55 is supported on the end of a transversely rotatable lever arm having a cam follower disposed at its other end for riding along a suitable annular control surface of a rotary cam keyed for rotation with the drive shaft 36. This lever arm is rotated under influence by the rotary cam so as to cause vertical reciprocation of the bar 55. In its initial position, the bar 55 is fully raised and the probe 53 is disposed directly over the loop opening developed in the bag at the station 21. After the loop opening has been formed, the bar 55 is lowered causing the probe 53 to pass directly into the loop opening of the bag fully beneath the lateral height of the bag fastener strip profiles 29. The drive station 23, more fully described below, now engages the chain 26 again for forward movement through the machine 19. This forward movement passes the initially opened bag from the station 21 into the filling station 22, during which time the descended probe 53 remains in position upstream of the gates 51 and 52 such that the remainer of the initially opened bag fastener strip profiles are plowed apart and so separated from one another. In this manner, a fully unlocked or opened bag is disposed in the filling station 22. As the tail end of the bag is conducted into the filling station 22, the tail side edge of the bag conducts the probe 53 against the bias of the torsion spring 56 forwardly, parting the gates 51 and 52. The change is indexed such that the probe 53 passes fully forwardly beyond the gates 51 and 52, whereupon the gates substantially close behind the probe 53 and thereby serve as a stop point against further rearward movement of the probe 53.

The drive station 23 operates so as cause a predetermined forward over-travel drawing of the bag chain 26, i.e. the opened bag is initially intentionally conducted a bit forwardly of the area of proper vertical alignment in the filling station 22. After this over-travel movement, the drive action on the chain 26 is again temporarily halted and a further probe 59 is passed into the opened bag.

Figure 7:
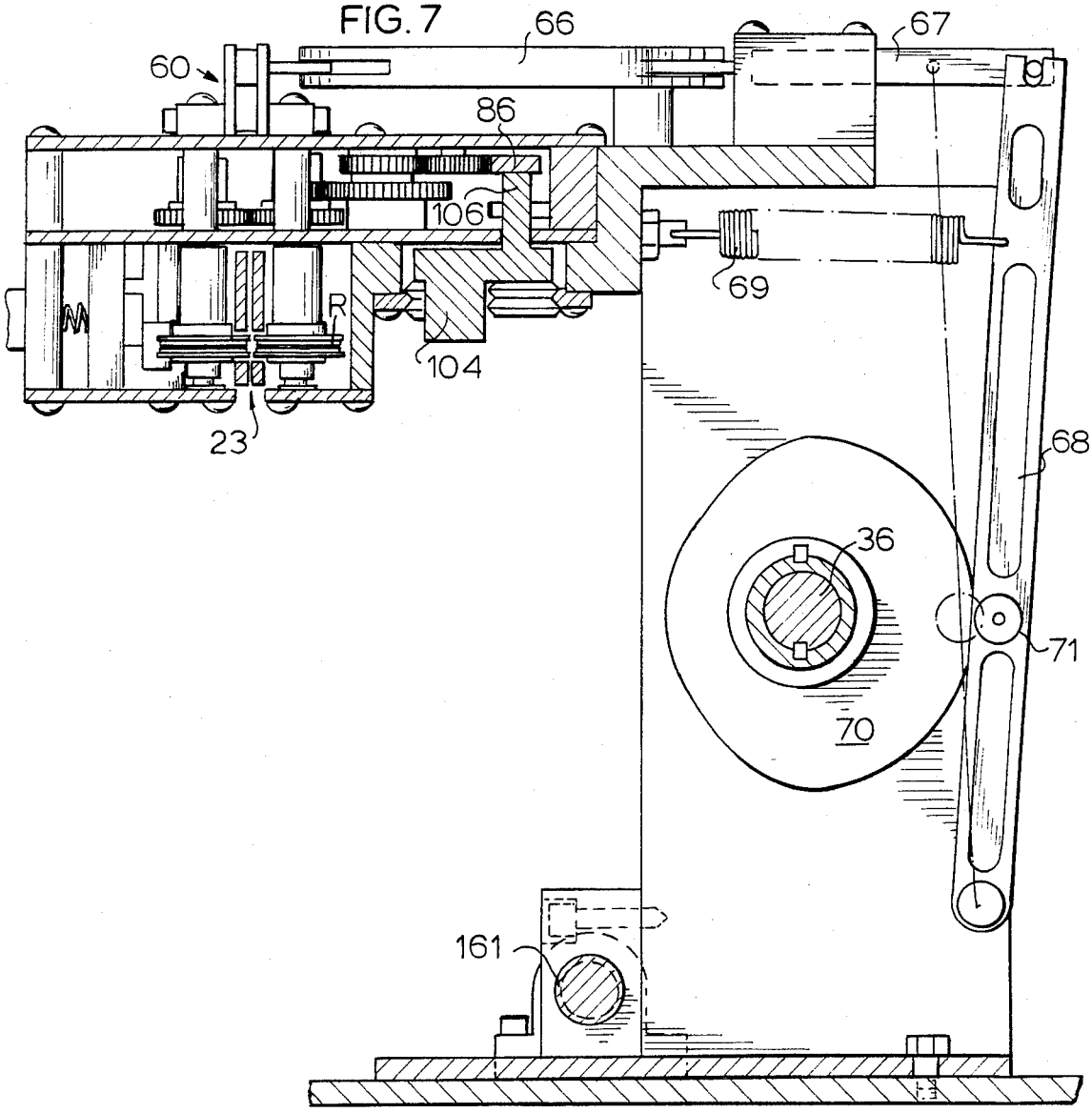
FIG. 7 is a cross-sectional view taken along the lines VII—VII of FIG. 2.
Figure 8:
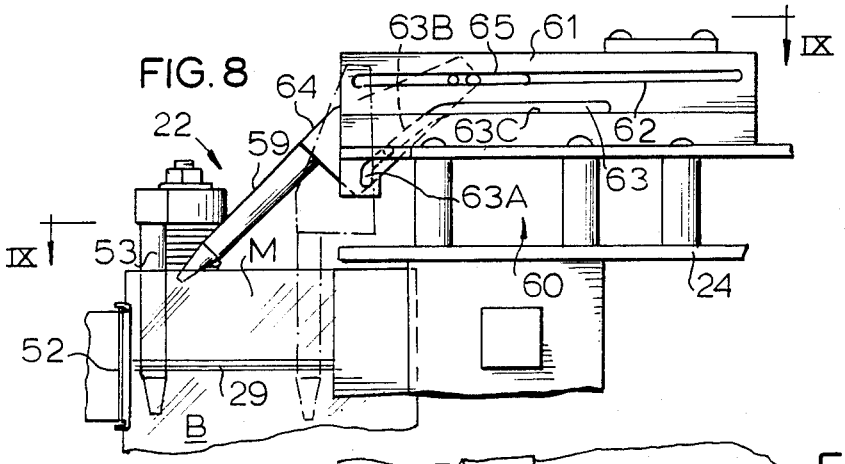
FIG. 8 is a fragmentary side elevational view of a further probe device used in the mechanism of FIG. 1.
Figure 9:
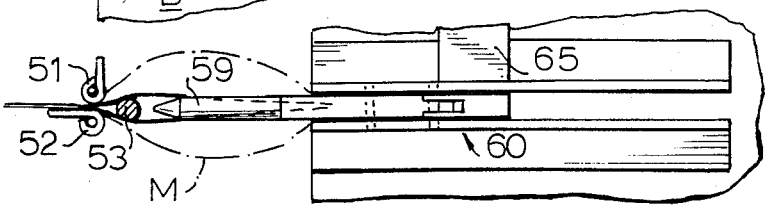
FIG. 9 is a partial sectional, plan view taken along the lines IX—IX of FIG. 8.

A mechanism 60 for controlling operation of the further probe 59 is disposed on the movable carriage 24. The operation of the mechanism 60 is illustrated in FIGS. 7–9. The mechanism 60 comprises a laterally extending cam track plate 61 upstanding from the top surface of the carriage 24. Running longitudinally along the plate 61 is a substantially linear upper track groove 62 and an angled lower track groove 63. The lower track 63 has a substantially vertically directed lead end portion 63A communicating with a downwardly extending portions 63B, the upper end of which leads into a substantially linear portion 63C. The track grooves 62 and 63 cooperatively receive respective travel pins disposed transversely outward from a movable bracket 64 the lead end of which supports the further probe 59. At the end of the bracket opposed from the further probe 59, there is connected a laterally reciprocable pusher element 65 connected to one end of a lever arm 66 journaled for rotation about a vertical axis upstanding from a fixed portion of the machine 19 housing.

As shown in FIG. 7, the opposed end of the lever arm 66 is connected to a transversely movable biasing bar 67, which is operated through pin connection with vertically extending cam follower arm 68. A spring connection 69 serves to bias the lower free end of the cam follower arm 68 against the annular control surface of a rotary cam 70 keyed for rotation with the shaft 36. A cam follower roller 71 is journaled in the arm 68 for riding over the cam 70. When the cam 70 is rotated such that the cam follower roller 71 is brought closer to the axis of the shaft 36, the pin connected end of the cam follower arm 68 moves from the solid line position to the phantom line position shown from the solid line position to the phantom line position shown in FIG. 7. This movement of the arm 68 causes the biasing bar 67 to rotate the lever 66 and accordingly pass the further probe bracket 64 laterally rearward along the plate 61. Nearing the end of this stroke, the bracket pin travel along the lower track groove 63 causes the bracket and associated probe 59 to follow an angularly downward directed path and finally be disposed in a position as shown by the phantom lines in FIG. 8 wherein the probe 59 is situated within the bag opening extending substantially vertically upright. When the cam follower arm 68 is moved away from the axis of the shaft 36, the movement of the probe 59 in its bracket 64 is reversed, withdrawing the probe from the bag opening.

The machine 19 is set such that the probe 59 enters the now opened bag mouth substantially mid-way of the bag width in the filling station 22. In its vertically upright end-stroke position, the probe 59 is located adjacent, but spaced from, the lead end of the bag. The probe 59 is of a length sufficient to extend into the bag substantially commensurate with the depth of penetration of the first probe 53, i.e. beneath the lateral height of the fastener strip profiles.

After the further probe 59 has descended into the opened bag in the filling station 22, the drive station 23 causes a positive rearward indexing of the chain 26 along the transport path. As this indexing begins, the biasing force of the torsion spring 56 connected with the first probe 53 causes the probe 53 to pass the tail side edge of the opened bag backward until the probe engages with the substantially closed gates 51 and 52, thereby fixing the tail end side walls of the opened bag against the facing surfaces of the gates 51 and 52 to prevent further rearwar travel of the tail end of the opened bag. The reverse drive is such that backward indexing of the chain 26 continues with a slack build-up developing in the opened bag positioned in the filling station 22. The presence of the first and second probes 53 and 59 within the bag interior prevents the bag side walls from folding over. As a result, slackening of the chain is relieved by a transversely bowing out of the opposed side walls of the opened bag forming a transversely widened bag mouth opening conducive for filling. Prior to the reverse drive slackening of the chain 26, the opened bag in the filling station presented only a narrow slit as shown by the solid lines in FIG. 9. This narrowly opened mouth of the bag is not conducive for loading the bag and, hence, the bag opening process of the present invention is a two-step technique, namely first disengaging the fastener strip profiles of the bag and then transversely widening or parting the fastener profiles from one another to enlarge the bag mouth opening into a substantially oval shape for filling. It should be noted that in the filling station 22, the opened bag is supported on at its bottom end, such as for example within a trough, and by its lateral connections with adjacent bags of the chain. In accordance with the invention, no mechanisms for clasping or gripping the opposed side walls of the bag are used in the filling station 22, so that the side walls of the bag are substantially unsupported and spreadable in the transverse direction.

The operation of the drive station is controllably set such that the positive reverse drive action on the chain 26 ceases when the oval shape mouth opening has been formed in the bag contained in the filling station 22. In timed sequence with the halt of the reverse drive, the cam follower arm 68 of the further probe mechanism 60 commences to be passed outwardly away from the axis of the shaft 36 such that the further probe 59 is withdrawn and retracted from the now wide open bag back to its initial, at rest position, as shown in FIG. 1. During retraction of the further probe 59, the first probe 53 is raised vertically upward as a result of cam-controlled operation of the bar 55. When the lower end of the first probe 53 is raised above the top edge of the bag mouth, holding pressure on the first probe against the rearward bias of the torsion spring 56 is removed and the first probe passes to its initial, at rest position vertically overlying the initial loop opening being formed in a subsequent bag in the station 21, an shown in FIG. 1. With the probes 53 and 59 removed from the wide open bag in the filling station 22, fill material is suitably deposited into the wide open bag through a chute 80, as shown in FIG. 1. A suitable dispensing mechanism may be used to release fill material down the chute 80 into the opened bag. This dispensing mechanism may be actuated manually or automatically in response to some trigger which, for example, may detect the retracting movement of one of the probes.

With the bag filled, the drive station 23 again causes the bag chain 26 to be conducted forwardly along the transport path for passage through the drive station 23. As the filled bag enters the drive station 23, the opposed fastener strip profiles are again received in further portions of the guide tracks 31. As the fastener strip profiles of the filled bag pass into the drive station 23, a convergingly directed lead end portion 81 of the subsequent part of the guide track 31 causes the opposed fastener profiles to be drawn together and pressed back into interlocking engagement with one another, such that the bag is both filled and re-closed as it is conducted on the chain through the drive station.

The operation of the drive station 23 is illustrated in FIGS. 10–15. Particularly with reference to FIGS. 10 and 15, th guide track 31 through the drive station 23 causes the outwardly protruding fastener strip profile portions of the filled and closed bag to pass between the nips of paired sets of bag drive wheels 82, 83, 84, and 85. Each of the drive wheels is formed with a suitably annularly recessed roll member R for providing frictional driving engagement against the protruding surfaces of the fastener strip profiles. Due to the relatively reduced thickness of the bag chain connecting links 27, these areas may manage to slip between the corresponding wheels of a singled drive wheel pair, such that positive drive on the chain 26 could be lost. Accordingly, a plurality of sets of drive wheel pairs are provided to assure a constant positive driving action on the chain during movement thereof along the transport path.

Figure 13:
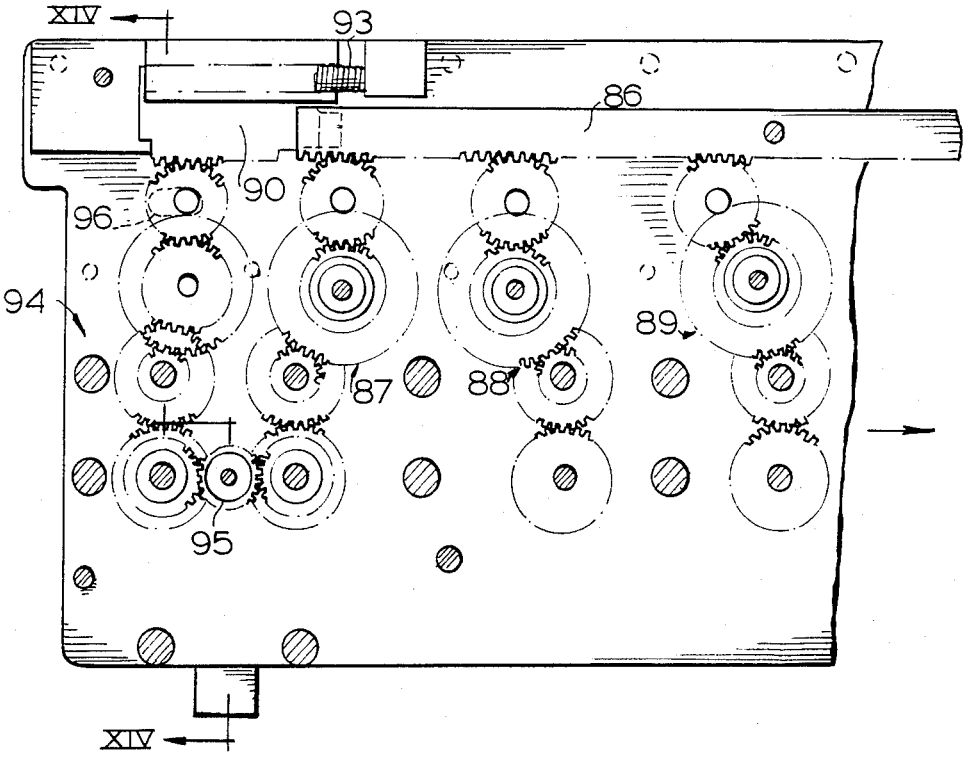
FIG. 13 is a cross-sectional view taken along the lines XIII—XIII of FIG. 2.
Figure 14:
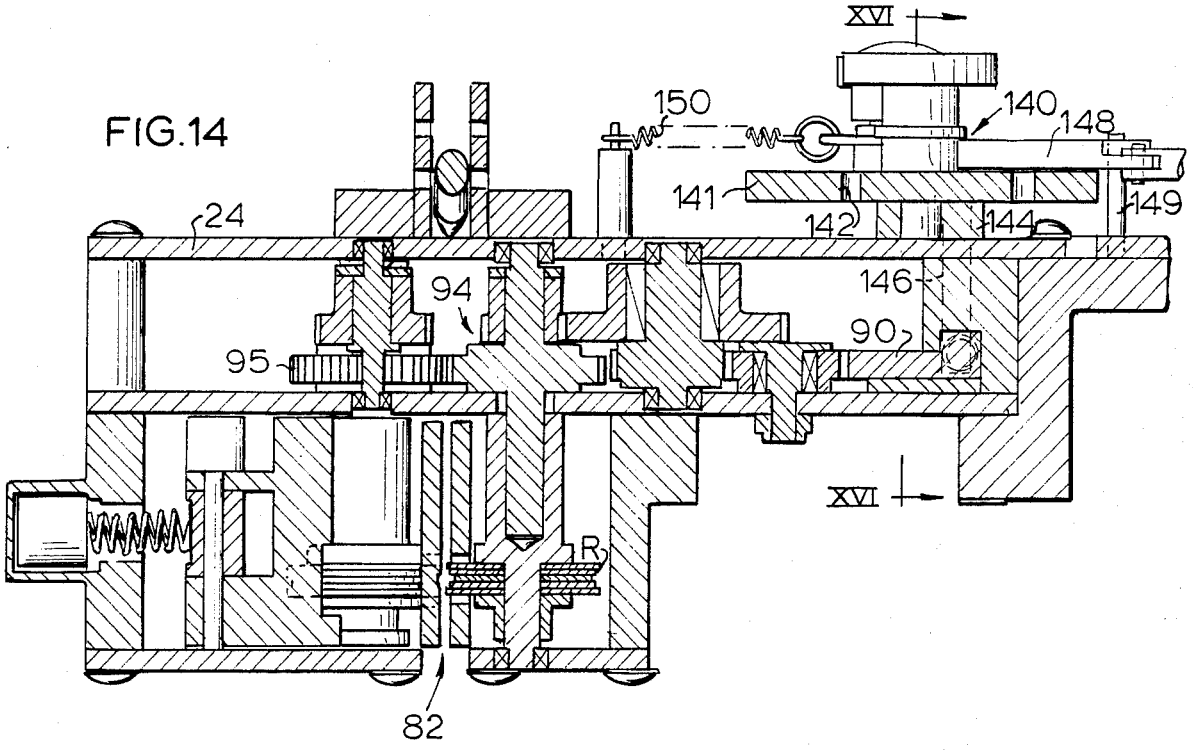
FIG. 14 is a cross-sectional view taken along the lines XIV—XIV of FIG. 13.

With references to FIGS. 13–14, there is shown the manner by which a controlled drive transmission is imparted to the sets of bag drive wheels shown in FIG. 15. For imparting forward drive movement to the drive wheels, a forward drive rack 86 is disposed for laterally reciprocable movement along one end of the drive station carriage 24. Driving teeth are formed along one lateral side of the forward rack 86 for driving engagement with three laterally spaced apart gear chain transmissions 87, 88, and 89. During positive forward movement of the bag chain 26 through the machine 19, the forward drive rack 86 passes in a leftward direction as viewed in FIG. 13 and the gear train transmissions 87, 88, and 89 are positively rotated such that the corresponding drive wheel pairs 83, 84, and 85 rotate counterclockwise as viewed in FIG. 15 to conduct the bag chain forwardly along the transport path 20. When the drive station 23 is operating to index the bag chain 26 laterally rearward in the machine 19, the forwar drive rack 86 is passed rightward as viewed in FIG. 13 and free-wheeling clutches suitably disposed in the gear chain transmissions 87, 88, and 89 prevent positive drive from being imparted from the forward rack 86 to the drive wheel sets 83, 84, and 85. For reasons explained further below, the drive wheel sets 84 and 85 are further provided with one-way shaft locks such that these drive wheels are not free-wheeling during reverse movement of the chain, but rather lock the bag held between their nips against rearward movement with the remainder of the chain.

Figure 11:
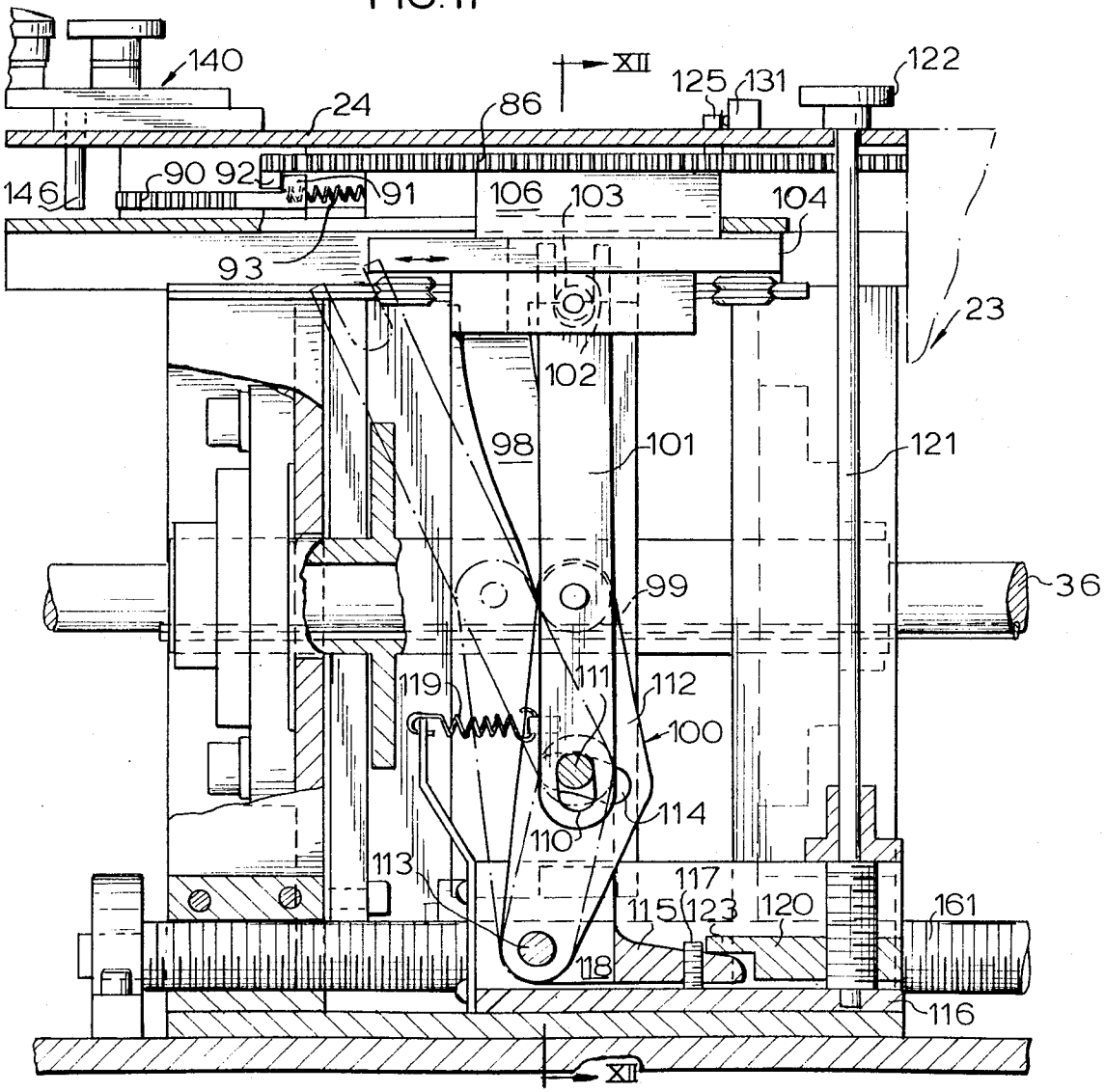
FIG. 11 is a cross-sectional view taken along the lines XI—XI of FIG. 10.

Laterally aligned with the forward drive rack 86, but disposed vertically beneath the forward rack, is a rear drive rack 90 suitably disposed for laterally reciprocable movement in the drive station carriage 24. As shown in FIG. 11, the rear drive rack 90 is formed with a forward end upturned lip 91 which faces the under surface of the forward drive rack 86. Correspondingly, the laterally rearward end of the forward rack 86 is formed with a downturned lip 92 for engaging with the rear drive rack lip 91 during rearward drive movement of the forward rack 86. The rear drive rack 90 is normally biased in the leftward direction as shown in FIGS. 11 and 13 by a coil spring 93. The rear drive rack 90 is formed with driving teeth along one side thereof for positively engaging with a further gear train transmission 94 drivingly connected to the remaining drive wheel set 82. A linking gear 95 is disposed between the gear chain transmissions 87 and 94. During forward drive movement of the bag chain 26 in the machine 19, the under surface of the forward drive rack 86 passes over the upturned lip 91 on the reverse rack 90, such that the reverse drive rack 90 does not move, being held under the influence of the biasing spring 93. As a result of this positive drive transmission to the gear chain 87, the connecting gear 95 transmits drive to the gear chain 94 operating the drive wheel set 82. Accordingly, the drive wheel set 82 serves to forward drive the bag chain along with the other drive wheel sets 83, 84, and 85. However, drive transmission is not passed through the qear chain 94 to the reverse drive rack 90 since a slot-type slip clutch 96 is mounted in the gear adjacent the driving teeth of the reverse rack. For imparting positive reverse drive to the bag chain 26 in the machine 19, the forward drive rack 86 is conducted in a rightward direction as viewed in FIG. 13. During the initial part of this movement, the downturned lip 92 on the forward rack 86 approaches the upturned lip 91 on the reverse rack 90 in a lost motion interval. During this interval no positive drive is imparted to any of the drive wheel sets 82–85, since the reverse rack 90 is not moved and the freewheel clutches in the gear chain transmissions 87–89 prevent the transfer of rotary motion therethrough. When the downturned lip 92 engages the upturned lip 91 of the reverse rack 90, continued rightward movement of the forward rack 86 conducts the reverse rack 90 rightward against the bias of the spring 93. This rightward movement of the reverse rack 90 brings about positive reverse drive, during which the reverse rack teeth drivingly engage the gear train transmission 94 and, via the connecting gear 95, that portion of the gear train 87 drivingly connected to the drive wheel set 82. As a result, reverse drive of the bag chain 26 is carried out by the drive wheel sets 82 and 83.

Figure 10:
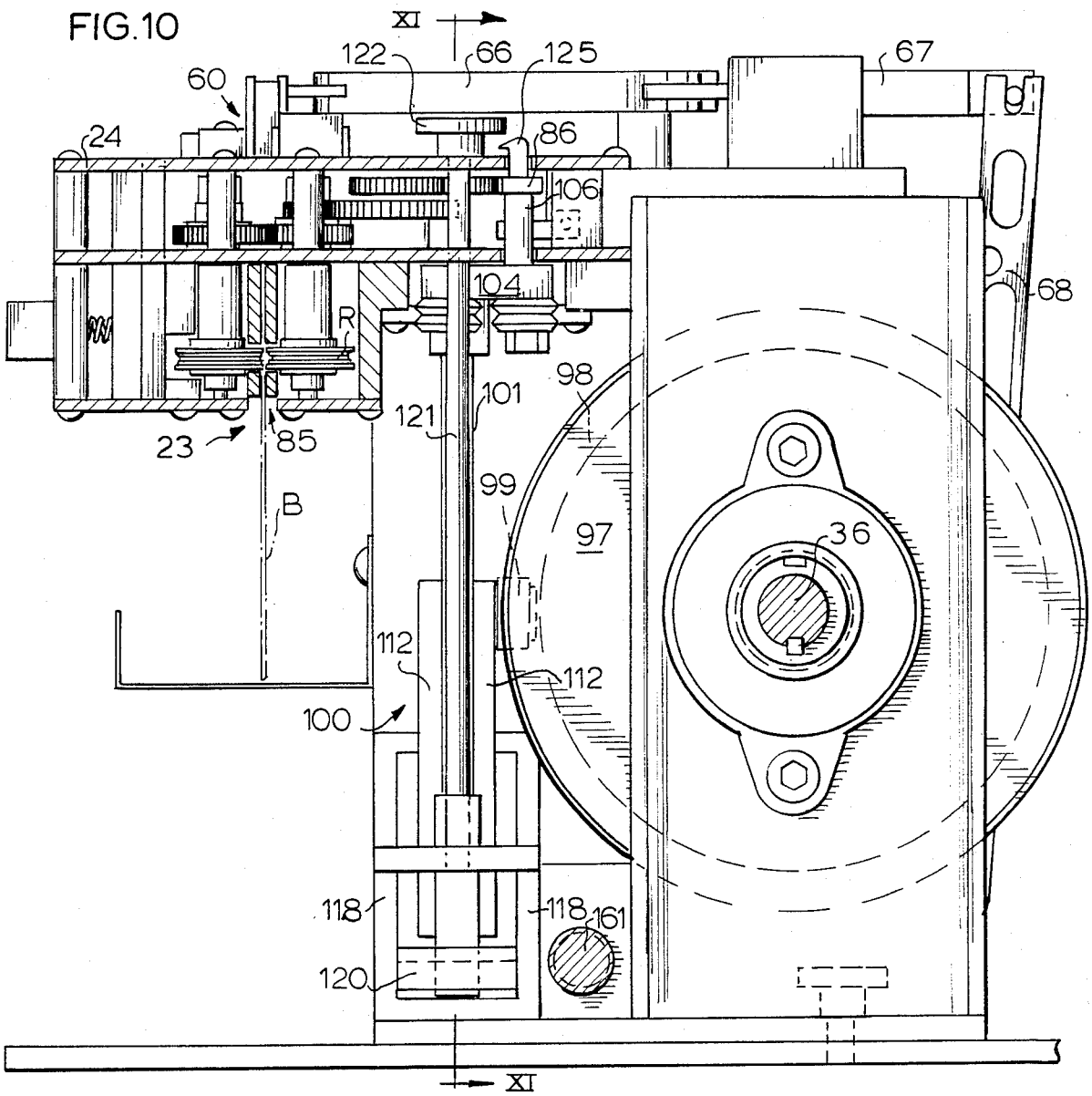
FIG. 10 is a cross-sectional view taken along the lines X—X of FIG. 2.
Figure 12:
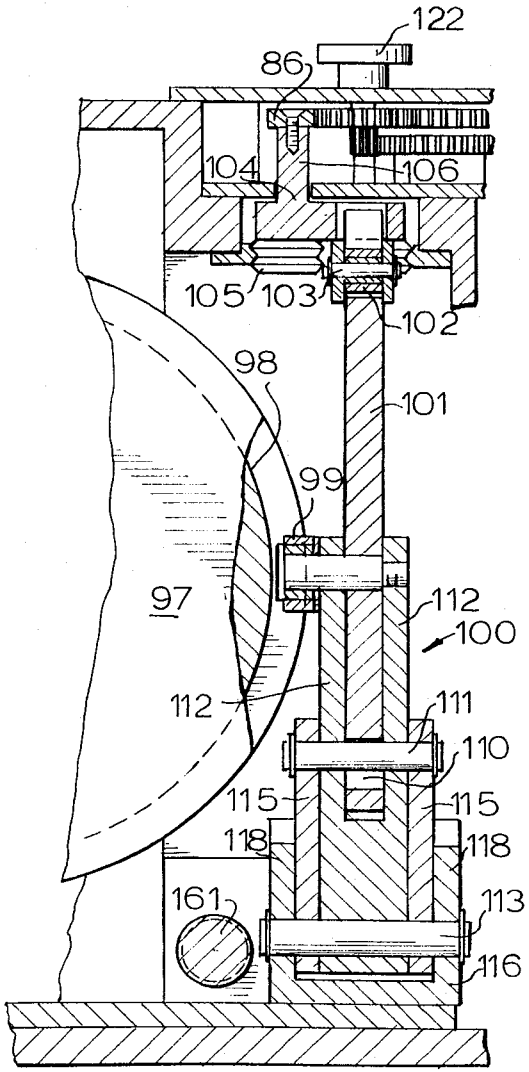
FIG. 12 is a cross-sectional view taken along the lines XII—XII of FIG. 11.

With reference to FIGS. 10–12, the lateral back and forth movement of the drive rack 86 is imparted as a result of a rotary cam 97 keyed for rotation on the shaft 36. The rotary cam 97 is provided with an annular, undulating cam track 98 for moving a cam follower 99 received therein in a uniform, substantially laterally back and forth motion.

An adjustable cam follower linkage device 100 is provided in connection with the machine 19 to transfer the back and forth motion of the cam follower 99 to the drive rack 86 and, at the same time, permit a variability of the stroke drive transmission, such that the length of the forward drive stroke in the drive station 23 can be variably selected depending on the particular width of bag of the particular chain 26 being handled by the machine 19. The cam follower linkage 100 comprises a relatively elongated, substantially upstanding drive link 101 journaled intermediately there along on the pin of the cam follower 99. The upper free end of the drive link 101 is fork-shaped defining a recess 102 for slightably receiving therethrough a roller 103 of a rack-conveyor carriage 104. The carriage 104 is supported on guide track rollers 105, as shown in FIGS. 11–12 and 15, for laterally reciprocable movement in the drive station 23 directly beneath the forward drive rack 86. A lug projection 106 upstanding from the carriage 104 is fixedly attached to the under surface of the drive rack 86, such that the movement of the carriage 104 controls the back and forth reciprocation of the drive rack 86. Accordingly, the lateral movement provided by the drive arm 101 of the cam follower linkage 100 controls the movement of the reciprocable carriage 104 and, hence, the lateral movement of the drive rack 86.

The lower end of the drive link 101 is formed with a vertically elongated or enlarged slot 110 receiving therethrough a journal pin 111 which, when the drive link 101 is substantially upright, is disposed adjacent the upper end of the slot 110. On opposed transverse sides of the drive link 101 is a pair of elbow-shaped pivot linkages 112. The upper ends of the pivot linkages 112 are journaled to the pin of the cam follower 99 and their lower ends, disposed beneath the journal pin 111, are disposed for rotation about a base pin 113. Intermediately of each pivot linkage 112, there is provided an arcuate-shaped elongated slot 114 for receiving therethrough in loose-fit fashion the journal pin 111.

On opposed transverse sides of the cam follower linkage 100 is a pair of nearly right-angle pivot stop members 115. The pivot stop members are each formed with a substantially laterally extending foot portion disposed over a fixed base wall 116 of the machine housing and provided with a vertically extending adjustable set screw 117 for setting the downward travel of the foot portion of the pivot stop member. The upper end of the substantially upstanding portion of each pivot stop member is hinged about the journal pin 111. The central or apex portion of each pivot stop member is journaled about the base pin 113.

The journal pin 111 and the base pin 113 extend in a transverse direction within the machine 19. The base pin 113 is held stationary, supported in end walls 118, as shown in FIG. 12.

The solid line representation of the cam follower linkage 100 in FIG. 11 illustrates the position of the linkage when the drive rack 86 has been brought fully rightward in the reverse stroke drive of the bag chain 26. A spring bias connection 119 acts against the lower end of the drive link 101 to bias the drive link in the forward drive motion direction of the drive rack 86.

The amount of forward stroke given to the drive rack 86 is determined by the amount of leftward laterally pivotal rotation afforded to the drive link 101. This movement, in turn, is controlled by the amount of vertical lift-off play over the base wall 116 available to the foot portion of the pivot stop members 115. The amount of such vertical lift-off play is set by the height of a stop plate 120 disposed for vertical movement along the threaded end of a vertically rotatable adjuster shaft 121. The adjuster shaft 121 is journaled at its lower end in the base wall 116 and extends fully upward through the top of the carriage 24 terminating in a manual control knob 122, adapted to be set by the machine operator. The stop 120 is formed with a ledge portion 123 over hanging of the upper surface of the pivot stop member foot portions to serve as an abutment there against.

As shown in FIGS. 11–12, the stop 120 is in its vertically lowermost position such that the ledge portion 123 prevents any vertical lift-off play of the foot portions of the pivot stop members 115. In this setting of the stop 120, the drive link 101 is afforded maximum laterally pivotal movement and, hence, the drive rack 86 is provided with its maximum stroke, conducive for handling maximum width bags through the machine 19, these maximum widths presently being on the order of six inches. In this operation of the cam follower linkage 100, the cam follower 99 is moved laterally leftward following the cam track 98. As the cam follower biases the drive link 101 laterally, the lower end of the drive link pivots fully about the journal pin 111 which remains substantially fixed due to the lack of movement of the upper ends of the upstanding portions of the pivot stop members.

If an intermediately sized width plastic bag, such as on the relative order of four-five inches, was being handled through the machine 19, the operator would rotate the control knob 122 in a direction which causes substantial elevation of the stop member 120. This intermediate positioning of the stop member 120 permits the foot portions of the pivot stop members 115 to travel through an arc of about 15 degrees off the lateral plane of the base wall 116. Accordingly, as the cam follower 99 is moved leftward along the cam track 98, the lower end of the drive link 101 carries with it the journal pin 111 through the arcuate slots 114 of the pivot linkages 112 and, at the same time, causing lateral pivotal movement of the upper ends of the upstanding portions of the pivot stop members 115 about the fixed base pin 113. A lost motion interval thereby develops in the rotation of the drive link 101 about the pin 111, such that maximum lateral rotation of the drive link is not achieved. Accordingly, the carriage 104 is passed leftward only about midway along its track and the drive rack 86 correspondingly achieves only an intermediate length stroke.

For a minimum sized width bag, on the order of three inches, being handled through the machine 19, the operator turns the control knob 122 so that the stop member 120 is fully elevated along the threaded portion of the adjuster shaft 121, allowing maximum vertical lift-off play of the foot portions of the pivot stop members 115. As a result, these foot portions pass through an angle above the lateral plane of the base wall 116 of about 30 degrees. In this setting, when the cam follower 99 is moved leftward along the cam track 98, the drive link 101 is barely able to achieve pivotal movement about the journal pin 111. This is because the journal pin 111 is free to be carried substantially along the arcuate slots 114 of the pivot linkages 112, until finally rotational movement of the upper ends of the upstanding portions of the pivot stop members 115 about the base pin 113 is haulted by abutment of the foot portions against the stop ledge 123. Correspondingly, the leftward strokes of the carriage 104 and drive rack 86 is minimal.

It will be appreciated that rightward movement of the drive link 101 always results in the drive link 101 being brought to its substantially fully upright position as shown in solid lines in FIG. 11, due to the lateral movement of the cam follower 99 in the cam track 98 and the resulting lowering of the foot portions of the pivot stop members 115 into abutment against the base wall 116. However, the set screws 117 disposed in the foot portions of the pivot stop members 115 are provided to enable fine tuning of the completion of the retraction stroke on the drive rack 86, which may become necessary due to wear or manufacturing tolerances. This uniform point of origin of the forward drive stroke on the drive rack 86 may be used as a means to scale off forward drive rack stroke lengths to correspond with the particular width size bags being handled through the machine 19. Accordingly, as shown in FIGS. 1 and 11, an indicator pin 125 is positioned upstanding from the top of the drive rack 86 and extends through a groove cut-out 126 formed in the upper surface of the drive station carriage 24. The groove cut-out 126 is appropriately scaled off, so that the operator may determined whether the stroke length he has set for the drive link 101 via the control knob 122 is appropriate for the particular bag size being handled by the machine 19.

Figure 17:
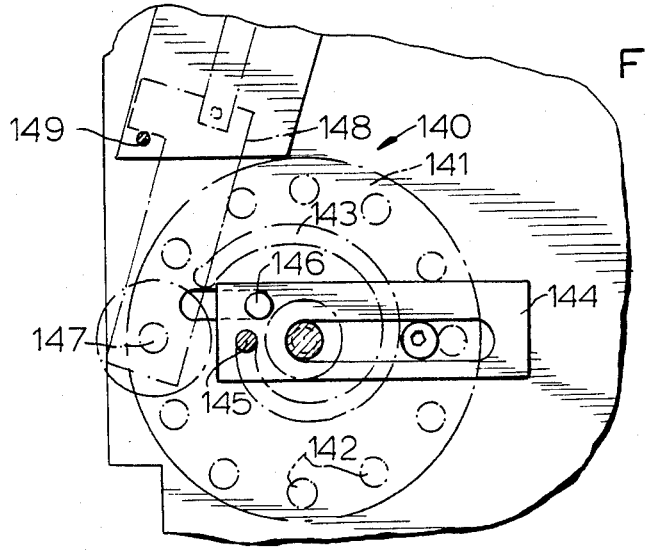
FIG. 17 is a fragmentary, plan view of a solenoid-adjusted cam plate for correcting the stroke length of the drive means in the mechanism of FIG. 1.

With reference to FIGS. 1 and 16–17, the machine 19 is also provided with a reverse stroke control mechanism 140 which permits variable adjustment of the length of reverse indexing action carried out by the reverse drive rack 90 as a further feature permitting the machine 19 to change over for handling bags of different width (i.e., lateral dimension) size. Just as in the case of compensating the forward drive stroke of the drive rack 86 for bags of different size, it is also necessary to compensate the reverse indexing stroke performed by the reverse drive rack 90. The reverse stroke control mechanism 140 comprises a rotatable cam plate 141 disposed for rotation about a vertical axis on the drive station carriage 24. The cam plate 141 is formed with an annular array of circumferentially spaced threaded bores 142. Inward of the bores 142, the cam plate 141 has a cam track groove 143 which spirals radially inward about the vertical axis. Beneath the cam plate in a laterally reciprocable slide block 144 having an upstanding pin 145 disposed in the groove 143 of the cam plate and a downwardly extending control stop in the form of a pin 146. The control stop 146 is disposed along the lateral travel path of the reverse drive rack 90 and may be abutted by the reverse rack 90 under the influence of the spring force 93. It will be appreciated that relative rotation of the cam plate 141 causes the slide block 144 (and hence control stop 146) to be moved laterally toward or away from the reverse rack 90 as a result of the travel of the block pin 145 along the spiralling cam track groove 143.

Depending on the relative lateral positioning the control stop 146, the reverse drive rack 90 will have a longer or shorter stroke when the downturned lip 92 of the forward drive rack 86 engages with the upturned lip 91 of the reverse rack 90. It will be appreciated that a longer reverse drive stroke will be necessary relative to wider bags and vice versa for shorter width bags. This relative lateral positioning of the control stop 146 is brought about by the lateral disposition of a slide block 144, which, in turn, is set by the rotational disposition of a cam plate 141. Accordingly, as shown in FIG. 17, the cam plate 141 is set such that the slide block pin 145 is positioned at the radially innermost end of the cam track groove 143. This then positions the control stop 146 at its laterally rightmost point, such that the reverse rack 90 is moved minimally leftward under the influence of the spring 93 and a minimal reverse stroke action can be performed by the reverse drive rack 90.

The slide block 144 and, hence, the control stop 146 are prevented from being laterally displaced once the cam plate 141 has been set by the operator since the cam track groove 143 holds the pin 145 against lateral shifting and rotational movement of the cam plate 141 is prevented by a latch arm device. The latch device comprising a manually adjusted screw 147 disposed at the free end of an arm 148. The screw is adapted to be received in a selected one of the threaded bores 142 of the cam plate. The cam plate is initially rotated as desired until the proper threaded bore 142 underlies the screw 147, whereupon the screw is inserted into the bore 142. As shown in FIGS. 1 and 17, the arm 148 is prevented by a stop element 149 from being shifted transversely outward as a result of counter clockwise rotation of the cam plate 141, which could be precipitated under the influence of the biasing spring 93. A spring connection 150 to the free end of the arm 148 serves to hold the arm in engagement against the stop element 149.

Should the machine 19 be intended to be used for relatively wider bag sizes, the operator would remove the latch screw 147 from the bore 142, as shown in FIG. 17, rotate the cam plate in a clockwise direction so as to cause the slide block 144 to pass laterally leftward and the control stop 146 with it, and then reinsert the latch screw 147 into the appropriate bore scaled for the proper reverse stroke action corresponding to the particular bag size being used.

With reference again to FIG. 15, the filled and closed bag immediately passing from the filling station 22 is received between the nips of the drive wheel sets 82 and 83 under the influence of the forward drive movement of the rack 86. The stroke length of the forward drive of the rack 86 is set such that before the lead end of the filled and closed bag is received in the nip of the drive wheel set 84, the forward stroke terminates and the rightward or reverse movement of the drive rack 86 begins. As a result of the separation between the downturned lip 92 on the rack 86 and the upturned lip 91 on the reverse rack 90, as shown in FIG. 11, movement of the bag chain 26 through the machine 19 is temporarily halted, during which time the further probe 59 is inserted into the subsequent opened bag positioned in the filling station 22 and the gripper 40 commences lateral movement of one fastener profile relative to another in a still further subsequent bag in the initial bag opening station 21. When the downturned lip 92 engages the upturned lip 91 of the reverse rack 90, the reverse rack is conducted rightward, as viewed in FIG. 11, for causing reverse drive rotation of the drive wheel sets 82 and 83, thereby moving th filling enclosed bag engaged thereby laterally backward and th remainder of the bag chain into the filling station 22 with it to effect the slack build-up transverse widening of the subsequent bag mouth for filling. Also during this reverse indexing of the bag chain, an immediately downstream filled and closed bag engaged between the drive roller sets 84 and 85 is held stationary due to the shaft locks associated therewith. As a result, the backward indexing of the filled and closed bag engaged between the drive wheel sets 82 and 83 tears apart the connecting link 27 with the immediately downstream bag, such that the filled and closed bag engaged between the drive wheel sets 84 and 85 is now separated from the bag chain 26. When the forward or leftward stroke of the drive rack 86 again commences, the filled and closed disposed between the drive wheel sets 82 and 83 is passed forwardly for engagement between one or both of the drive wheel sets 84 and 85, depending on the width of the bag, and the now separated filled and closed bag is indexed forwardly along the transport path 20.

The drive station 23 may incorporate a suitable separately operated auxiliary bag drive mechanism at 130, as shown in FIG. 1, for receiving the separated filled and closed bag from the drive wheel set 85 to convey the separated bag through a sealing mechanism which will seal the oppositely disposed side walls of the bag overlying the fastener strip profiles to provide pilfer-proof lock on the filled and closed bag. Preferably, the drive wheel sets referred to in connection with FIG. 15 permit relatively high-speed operation, which velocities may be unsuitable for bag conveyance through a sealing mechanism. Accordingly, it is within the contemplation of the present invention for auxiliary drive 130 to be a relatively slower speed device and it should be noted that this arrangement will not cause jam-up of bags in the drive station due to the periodic stopping and reverse indexing of the remainder of the chain. In a preferred manner of controlling the operation of the auxiliary drive 130, there is provided a limit switch mechanism 131 disposed on the top of the drive station carriage 124 to be triggered by engagement of the indicator 125 when the drive rack 86 reaches the end of its reverse stroke. The limit switch 131 may activate a suitable solenoid arrangement for energizing the auxiliary drive 130.

If the pilfer-proof sealing mechanism is employed, the guide track 31 may be extended therethrough and terminate at the downstream end of the sealing mechanism for discharge of the separated and sealed bag from the machine 19 for packaging as desired. If the sealing mechanism 25 is not used, the guide track 31 terminates at the downstream end of the drive station 23 and there discharges the separated bag from the machine 19 for suitable packaging.

The tendency of bag chains to become misaligned before the various work stations of the machine 19 due to slack or manufacturing tolerances in the chains is compensated for in the following manner. Operation of the machine 19 is set such that the support arm 54 containing the first probe 53 makes a substantially predetermined arc swing as a initially opened bag is conducted from the opening station 21 into the filling station 22, carried by engagement with the trail side edge of the opened bag. Should the bags of the chain begin to undergo excessive over-travel initially into the filling station 22, there is provided, as shown in FIG. 1, a trigger pin 153 extending outward from the support arm 54 which would engage a limit switch 151. The limit switch 151 is arranged to operate a solenoid motor 152 operatively connected to the latch arm 148 of the reverse indexing control mechanism 140 to retract the arm 148 in predetermined small increments at a time transversely inward and away from the stop element 148. This retraction of the arm 148 causes the cam plate 141 to rotate clockwise, as shown in FIG. 17, passing the slide block pin radially outward along the cam track groove 143. Accordingly, the control stop 146 is shifted leftward, bringing about a longer operative reverse stroke to the drive rack 90. The back travel of the chain is then increased and the excessive over-travel is immediately counteracted and eliminated.

Excessive under-travel of the bags through the machine 19 can be readily corrected by adjustment of the control knob 122 affecting the length of forward travel stroke of the forward drive rack 86.

In addition to adjusting the forward and reverse drive strokes of the machine bag drive to changeover operation from one bag width size to another, the drive station carriage 24 is adapted for lateral movement along the length of the machine. In this manner, the operator properly aligns the filling station 22 and associated feed shute 80, the disposition of the second probe mechanism 60, and the drive wheel sets of the drive station 23 along the length of the machine 19 for proper handling of bags of different sizes. With reference to FIGS. 1 and 11, there is illustrated a screw drive arrangement 160 comprising a threaded shaft 161 on which the carriage 24 is suitably disposed for lateral movement there along. A hand crank 162 may be used to rotate the screw shaft 161 for controlling the relative lateral positioning of the drive station carriage 24 within the machine 19.

The mechanism described above is uniquely adapted for automatically filled reclosable plastic bags particularly with respect to fastener strip profile-type bags. The apparatus of the present invention permits the mechanism to be readily changed over from use with a bag of one particular lateral width size to handling bags of a different particular lateral width size. The mechanism is uniquely arranged to conduct a bag chain therethrough and effect opening, filling, reclosing, and individually separating filled and closed bags from the remainder of the chain for further packaging automatically.

Although various minor modifications may be suggested by those versed in the art, it should be understood that we wish to embody within the scope of the patent warranted hereon all such modifications as reasonably and properly come within the scope of our contribution to the art.

I claim as my invention:

1. An automatic packaging apparatus for vertically filling plastic bags laterally interconnected with one another in a chain wherein each bag has closed bottom and side edges and a reclosable upper end mouth having interlocking fastener strip profiles running laterally across opposed inner facing surfaces of said mouth and wherein each bag is initially received in said apparatus with the fastener strip profiles interlocked, comprising:

a first work station for unlocking the fastener strip profile and opening the mouth of each bag for filling, means for filling each bag, a second work station for relocking the fastener strip profiles of each bag after filling and for separating each filled and relocked bag from the remainder of said chain, a drive means for laterally conducting said chain through said first and second work station, said drive means alternately imparting forward and reverse stroke movements to said chain for conveying each bag of said chain from one work station to the other and separating each filled and relocked bag from the remainder of said chain, respectively, and a control means for adjusting the length of forward and reverse stroke movement imparted by said drive means such that said apparatus is adapted to handle bags of various lateral dimensions.

2. The automatic packaging apparatus of claim 1, wherein said drive means comprises separate, linearly movable forward and reverse drive racks for respectively driving at least one pair of rotatable wheels, disposed on opposed sides of said chain and frictionally engaging said bags, through gear transmission means.

3. The automatic packaging apparatus of claim 2, wherein said control means comprises a uniform drive input and an adjustable lost motion linkage for connecting said drive input to at least one said drive rack.

4. The automatic packaging appratus of claim 3, wherein said drive input is provided by a rotary cam and said lost motion linkage comprises a cam follower cooperating with said rotary cam, a drive link connected at one end with said at least one drive rack, having a longitudinally elongated slot about a journal pin at its other end, and pivotably connected to said cam follower intermediately therealong, a pivot linkage pivotably connected at one end with said cam follower, at its other end about a fixed base pin, and formed with a transversely elongated slot about said journal pin, and an elbow-shaped pivot stop member having an upstanding portion pivotably connected to said journal pin, an apex portion pivotable about said base pin, and a foot portion movable between stop surfaces, at least one of which is adjustable.

5. The automatic packaging apparatus of claim 4, wherein said at least one drive rack is said forward drive rack.

6. The automatic packaging apparatus of claim 2, wherein at least one said drive rack is biased in a direction opposite to its drive stroke and said control means comprises a linearly adjustable stop for opposing further movement of said at least one drive rack in the direction of said bias.

7. The automatic packaging apparatus of claim 6, wherein said control means further comprises a rotatable cam plate having an inwardly spiralling cam track cooperatively engaged with said stop for selectively setting the relative linear position of said stop.

8. The automatic packaging apparatus of claim 7, wereinsaid at least one said drive rack is said reverse drive rack.

9. A method for changing over operation of a machine for filling bags to handle bags of varying in lateral widths, said bags being laterally interconnected with one another in a chain and each having reclosable mechanically interlocked upper end mouths through which fill material is passed into the bag, and said machine having a drive means for laterally conducting said chain through various work stations for opening, filling, reclosing, and separating filled and closed bags from the chain, said drive means alternately imparting forward and reverse stroke movements to said chain, comprising:

separately adjusting the lengths of the forward and reverse stroke movement imparted by said drive means in accordance with the different lateral widths of bags.

10. In an apparatus for automatically filling plastic bags one at a time laterally connected together in a chain, each bag having reclosable, mechanically interlocked upper end mouth sidewalls between which fill material is passed into the bag, a drive for alternately imparting forward stroke movements to said chain such that the bags of said chain are passed sequentially through various bag opening, filling, closing, and separation work station and reverse stroke movements to said chain such that each bag of said chain is slackened for transverse spreading of said mouth sidewalls in said filling work station and separated from the remainder of said chain in said separation work station, said drive imparting a predetermined forward movement overtravel to each bag entering said filling station to be corrected by said reverse stroke movement, and a control means for detecting excessive overtravel of any bag in said filling station and lengthening the reverse stroke movement of said drive to compensate for such excessive amount of overtravel.

11. In an apparatus for automatically filling plastic bags one at a time laterally connected together in a chain, said bags each having closed bottom and side edges and a reclosable upper end mouth having interlocking fastener strip profiles running laterally across inner facing surfaces of said mouth, an intermittently operating drive for conducting said chain in strokes along a lateral transport path between various work station fixed along said transport path, a displacement means for providing a uniform stroke input, and a connector linkage between said displacement means and said drive for controlling the stroke lengths of said drive, said connector linkage having a lost motion variably adjustable to set said drive for use with respective said bags of different lateral dimensions to assure proper registrations thereof before said work station.

12. The apparatus of claim 11, wherein said displacement means comprises a rotary cam and said connector linkage comprises a cam follower cooperating with said rotary cam, a drive link operatively connected at one end to said drive, having a longitudinally elongated slot about a journal pin at its other end, and pivotably connected to said cam follower intermediately therealong, a pivot linkage pivotably connected at one with said cam follower, at its other end about a fixed base pin, and formed with a transversely elongated slot about said journal pin, and an elbow-shaped pivot stop member having an upstanding portion pivotably connected to said journal pin, an apex portion pivotable about said base pin, and a foot portion movable between stop surfaces, at least one of which is adjustable.

13. The apparatus of claim 11, wherein said drive comprises a linearly movable driven rack and said connector linkage comprises a linearly movable drive rack for engaging said driven rack through a lost motion connection, said driven rack being biased at one end in a direction through the lost motion connection and facing against a stop at the other end, and control means for selectively adjusting the relative lateral position of said stop to vary the lost motion connection.

* * * * *